US011300287B2

(12) United States Patent
Salonen et al.

(10) Patent No.: US 11,300,287 B2
(45) Date of Patent: Apr. 12, 2022

(54) SUPPORT ASSEMBLY FOR A BOILER

(71) Applicant: Valmet Technologies Oy, Espoo (FI)

(72) Inventors: Pasi Salonen, Orivesi (FI); Tero Heino, Tampere (FI)

(73) Assignee: Valmet Technologies Oy, Espoo (FI)

( * ) Notice: Subject to any disclaimer, the term of this patent is extended or adjusted under 35 U.S.C. 154(b) by 0 days.

(21) Appl. No.: 17/052,698

(22) PCT Filed: Apr. 16, 2019

(86) PCT No.: PCT/FI2019/050306
§ 371 (c)(1),
(2) Date: Nov. 3, 2020

(87) PCT Pub. No.: WO2019/215383
PCT Pub. Date: Nov. 14, 2019

(65) Prior Publication Data

US 2021/0239313 A1 Aug. 5, 2021

(30) Foreign Application Priority Data

May 11, 2018 (FI) ..... 20185431

(51) Int. Cl.
*F22B 37/24* (2006.01)
*F22B 37/14* (2006.01)
(Continued)

(52) U.S. Cl.
CPC ..... *F22B 37/24* (2013.01); *F22B 37/143* (2013.01); *F22B 37/201* (2013.01);
(Continued)

(58) Field of Classification Search
CPC ..... F22B 37/24; F22B 37/207; F22B 37/20; F22B 37/141; F22B 37/201; F22B 37/202; F22B 37/244; F16L 3/00
See application file for complete search history.

(56) References Cited

U.S. PATENT DOCUMENTS 2,948,267 A 8/1960 Koch et al.
3,811,415 A * 5/1974 Lawrence et al. .... F22B 37/201 122/478
(Continued)

FOREIGN PATENT DOCUMENTS

DE 1475856 A1 2/1969
DE 1526931 A1 4/1970
(Continued)

OTHER PUBLICATIONS

Office Action for Finnish Patent Application No. 20185431, dated Nov. 15, 2018, (7 pages), Finnish Patent and Registration Office, Tampere, Finland.
(Continued)

*Primary Examiner* — Gregory A Wilson
(74) *Attorney, Agent, or Firm* — Alston & Bird LLP

(57) ABSTRACT

A support assembly (40) for supporting the furnace (22) of a boiler (10) to a support frame (12) of the boiler. The support assembly comprises a first and second assembly parts (56, 8). The first assembly part (56) attaches a pipe (18), f.ex. a downcomer, to a supporting beam (32, 88). The second assembly part (58) attaches the same pipe (18) to another supporting beam (30, 86). The support assembly (40) may be obliquely positioned. Alternatively, the support frame further comprises an oblique, connecting supporting beam (84) that connects the first and second assembly parts. In this case, the first and second assembly parts attach the pipe to the connecting supporting beam (84). The first and second assembly parts define first and second points of support (52, 4) that transmit loads. The first or second assembly part may be a hanger rod. A boiler plant comprises the above-mentioned boiler, support frame for the boiler and support assembly.

21 Claims, 7 Drawing Sheets

(51) Int. Cl.
*F22B 37/20* (2006.01)
*F22B 37/22* (2006.01)

(52) U.S. Cl.
CPC ..... *F22B 37/204* (2013.01); *F22B 37/207* (2013.01); *F22B 37/22* (2013.01)

(56) References Cited

U.S. PATENT DOCUMENTS

| | | | | |
|---|---|---|---|---|
| 4,240,234 | A | 12/1980 | Eisinger et al. | |
| 5,207,184 | A | 5/1993 | Kreider | |
| 5,557,901 | A | 9/1996 | Hoosic et al. | |
| 7,240,640 | B2 * | 7/2007 | Kinnunen ..... | F22B 37/244 122/450 |
| 2016/0265243 | A1 * | 9/2016 | Shimono ..... | F22B 37/244 |
| 2020/0292164 | A1 * | 9/2020 | Lankinen ..... | F22B 37/244 |

FOREIGN PATENT DOCUMENTS

| | | | |
|---|---|---|---|
| GB | 1213053 | A | 11/1970 |
| KR | 100808358 | B1 | 2/2008 |
| WO | 2001-536756 | * | 10/2001 |
| WO | WO-2017/220846 | A1 | 12/2017 |
| WO | WO-2019/076427 | A1 | 4/2019 |
| WO | 2019-40543 | * | 8/2020 |

OTHER PUBLICATIONS

International Searching Authority, International Search Report and Written Opinion for International Application No. PCT/FI2019/050306, dated Jul. 22, 2019, (15 pages), European Patent Office, Rijswijk, Netherlands.

International Preliminary Examining Authority, International Preliminary Report On Patentability for International Application No. PCT/FI2019/050306, dated Jun. 5, 2020, (18 pages), European Patent Office, Mumich, Germany.

Office Action for Finnish Patent Application No. 20205795, dated Mar. 11, 2021, (6 pages), Finnish Patent and Registration Office, Tampere, Finland.

Office Action for Finnish Patent Application No. 20185431, dated Aug. 12, 2021, (6 pages), Finnish Patent and Registration Office, Tampere, Finland.

* cited by examiner

SUPPORT ASSEMBLY FOR A BOILER

CROSS REFERENCE TO RELATED APPLICATIONS

This application is a National Stage Application, filed under 35 U.S.C. 371, of International Application No. PCT/FI2019/050306, filed Apr. 16, 2019, which international application claims priority to and the benefit of Finland Application No. 20185431, filed May 11, 2018; the contents of both of which as are hereby incorporated by reference in their entirety.

BACKGROUND

Related Field

The solution to be presented relates to a support assembly for supporting the furnace of a boiler to a support frame of the boiler. The solution to be presented further relates to a boiler plant comprising a boiler, a support frame for the boiler and a support assembly.

Description of Related Art

Power boilers, especially steam boilers of CFB (circulating fluidized bed) and BFB (bubbling fluidized bed) design, may be bottom, top or middle supported. In a boiler with a bottom-support system a furnace of the boiler is taken as load that is supported from the bottom by means of a support frame that is a steel structure with horizontal supporting beams and vertical pillars. In a boiler with a top-support system the furnace is taken as load that is supported from the top and suspended from the horizontal supporting beams of the support frame. In a boiler with a mid-support system, the furnace is taken as load that is supported from a mid-point of the furnace by means of the support frame.

The mid-support system is less expensive than the top-support system and less thermal expansion takes place in the top sections of the boiler than in a boiler with a bottom-supported system in which sealing may be problematic due to the thermal expansion.

Attaching the furnace to the support frame of the mid-support system may cause deflection of the walls of the furnace due to loading of brackets and other support assemblies connecting the walls to the support frame, for example to supporting beams of the support frame. As a remedy, reinforcing beams are needed to support the walls and to reduce wall deflection. Therefore, special care should be taken of bending moments at the support assemblies, induced by the weight of the furnace itself.

BRIEF SUMMARY

The support assembly for supporting the furnace of a boiler to a support frame of the boiler according to the solution is presented in claim 1 and in claim 2. The boiler plant comprising a boiler, a support frame for the boiler and the above-mentioned support assembly according to the solution is presented in claim 16.

In the support assembly according to the present solution the furnace comprises four vertical, planar water tube walls which are joined together and which, in a horizontal plane, define a rectangular cross section with four corner sections, two of the water tube walls being joined in each corner section, the four corner sections including a first corner section at which a first water tube wall and a second tube wall that are transverse to each other are joined.

The boiler further comprises at least one vertically extending pipe that is for the transport of water and/or steam and situated outside the furnace, the pipe being close to the first corner section. The support frame further comprises at least two horizontal supporting beams which are separated from the water tube walls and include a first supporting beam and a second supporting beam that are transverse to each other.

In the solution, the support assembly close to the first corner section comprises a first assembly part and a second assembly part. The first assembly part attaches the pipe to the first supporting beam, or to a third supporting beam supported to the first or second supporting beam, wherein the first assembly part defines, at the first or third supporting beam, a first point of support where loads incurred by the weight of the pipe and the furnace attached to the pipe are transmitted to the first or third supporting beam. The second assembly part attaches the same pipe to the second supporting beam, or to a fourth supporting beam supported to the second supporting beam, wherein the second assembly part defines, at the second or fourth supporting beam, a second point of support where loads incurred by the weight of the pipe and the furnace attached to the pipe are transmitted to the second or fourth supporting beam. The support assembly is oblique in relation to the first and second supporting beams.

Alternatively, the support frame further comprises a connecting supporting beam that is separated from the water tube walls and comprises a first end attached to the first supporting beam, or to a third supporting beam supported to the first or second supporting beam, and a second end attached to the second supporting beam, or to a fourth supporting beam supported to the second supporting beam.

In the above-mentioned alternative case of the solution, the first assembly part attaches the pipe to the connecting supporting beam, wherein the first assembly part defines, at the connecting supporting beam, a first point of support where loads incurred by the weight of the pipe and the furnace attached to the pipe are transmitted to the connecting supporting beam. The second assembly part attaches the same pipe to the connecting supporting beam, wherein the second assembly part defines, at the connecting supporting beam, a second point of support where loads incurred by the weight of the pipe and the furnace attached to the pipe are transmitted to the connecting supporting beam. The connecting supporting beam is oblique in relation to the first and second supporting beams.

According to an example, the first and second assembly parts each comprises a suspension device that suspends the pipe from one of the supporting beams, or alternatively from the connecting supporting beam, and provides one of the points of support. According to an example, the suspension device is an adjustable hanger rod.

According to another example, the first and second assembly parts each comprises a supporting leg that is supported by one of the supporting beams and provides one of the points of support.

The boiler plant in which the present solution may be applied comprises the boiler, the support frame for the boiler and the support assembly as explained above.

The support assembly of the presented solution provides the benefit of reducing the bending moments to which a pipe is subjected, and furthermore, avoiding deflections caused by loads incurred by the weight of the pipe and the furnace attached to the pipe.

The above-mentioned benefits are made possible by having not one but two points of support which provide two supporting forces, or two resultant supporting forces, that generate bending moments which cancel each other out either partly or completely at the location of the pipe.

The presented solution will be more fully appreciated by reference to the following detailed description of the illustrative embodiments in accordance with the solution, when taken in conjunction with the accompanying illustrative drawings.

DETAILED DESCRIPTION OF VARIOUS EMBODIMENTS

In the figures, the vertical direction is denoted by an arrow Z and two orthogonal, horizontal directions are denoted by arrows X and Y. The horizontal directions are orthogonal in relation to the vertical direction.

Figure 1:
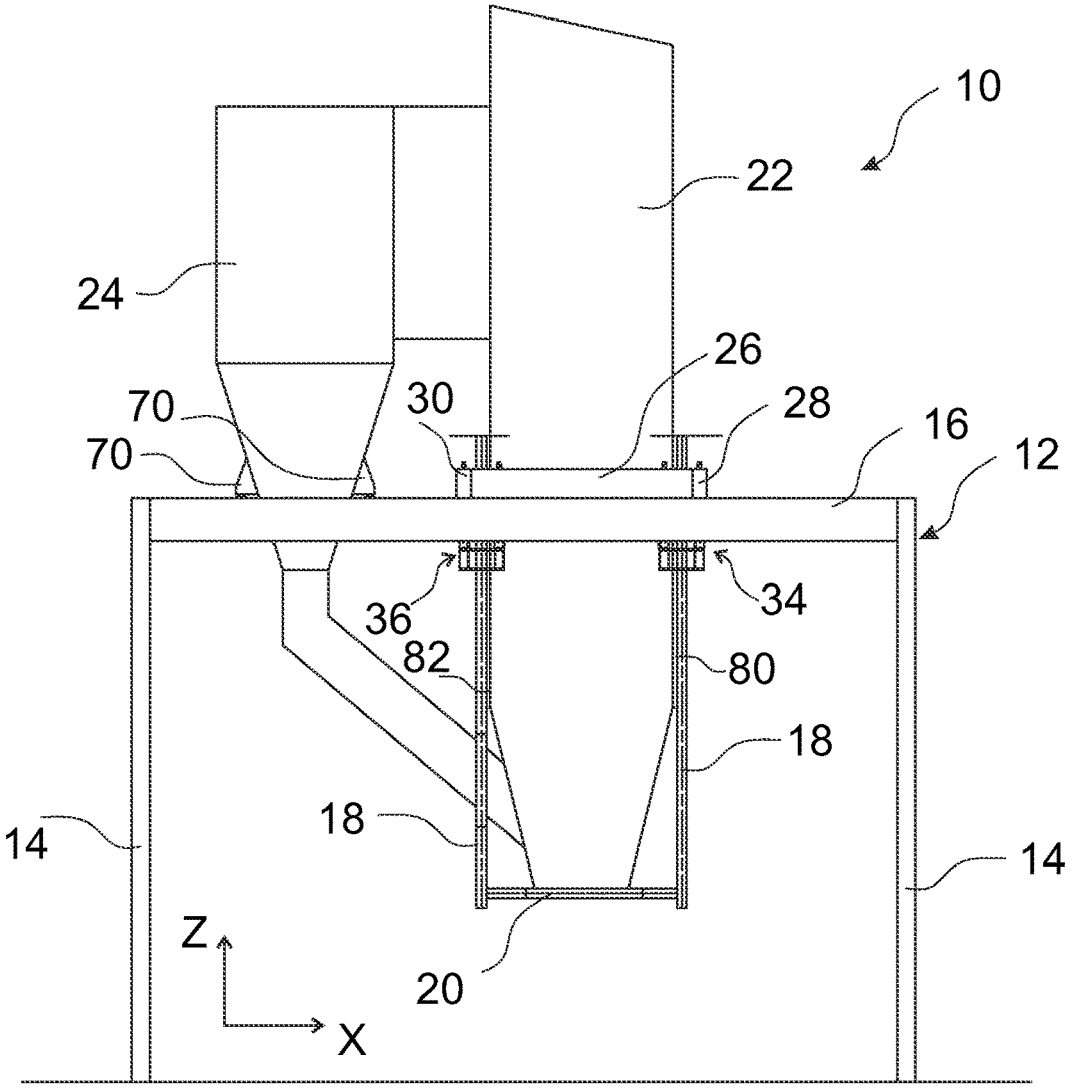
FIG. 1 schematically illustrates, in a simplified manner, a side view of a boiler plant, a boiler and a support frame in which the present solution is applied.
Figure 2:
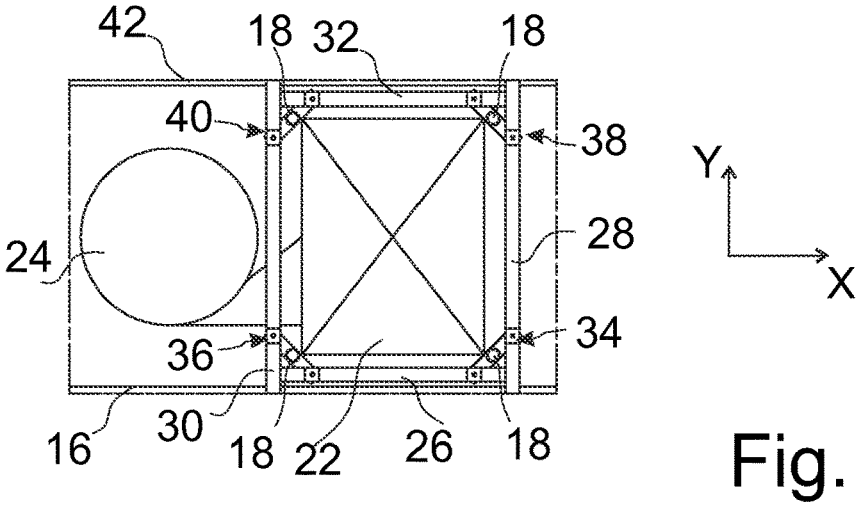
FIG. 2 schematically illustrates, in a simplified manner, a partial top view of the boiler plant, the boiler and the support frame of FIG. 1.

The boiler plant in FIGS. 1 and 2 according to an embodiment of the solution comprises, at least, a boiler 10 with a furnace 22, a support frame 12 for supporting the boiler 10 to the ground and one or more support assemblies 40 for supporting the furnace 22 to the support frame 12.

The support frame 12 comprises several horizontal supporting beams 16, 26, 28, 30, 32, 42 to which the furnace 22 is attached and/or which support the furnace 22 so that the furnace 22 is supported to the ground. Some of the supporting beams may support each other. The supporting beams are supported to the ground by vertical pillars 14 of the support frame 12.

Preferably, the boiler 10 is a steam boiler of CFB (circulating fluidized bed) or BFB (bubbling fluidized bed) design. The boiler 10 may comprise further devices that are relevant for the design in question but are not shown in the figures, for example a boiler and steam circulation system, flue gas channels, superheaters, an economizer, a back pass and a fly ash collection system.

The boiler 10 may additionally comprise a cyclone separator 24 connected to the furnace 22 for separating solid particles from flue gases coming from the furnace 22. The cyclone separator 24 is supported to the support frame 12, for example, by one or more support assemblies, for example supporting legs 70.

The boiler 10 may be, as shown in FIG. 1, mid-supported in such a way that in the vertical direction the furnace 22 extends both higher and lower than at least some of the above-mentioned supporting beams, for example the supporting beam 16 that is attached to the vertical pillars 14, and the supporting beams 30, 32. Alternatively, the furnace 22 extends mostly higher than the supporting beams mentioned above, or, is in a vertical direction situated completely above the supporting beams, in which case the boiler 10 may be considered to be bottom-supported, and the furnace 22 is supported from below.

The benefit of having the boiler 10 mid-supported is that the cyclone separator 24 may be supported to the support frame 12 in such a way that the cyclone separator 24 extends higher than at least some of the above-mentioned supporting beams, for example the supporting beam 16. The cyclone separator 24 may now be supported from below by, for example, the supporting beam 16.

Figure 3:
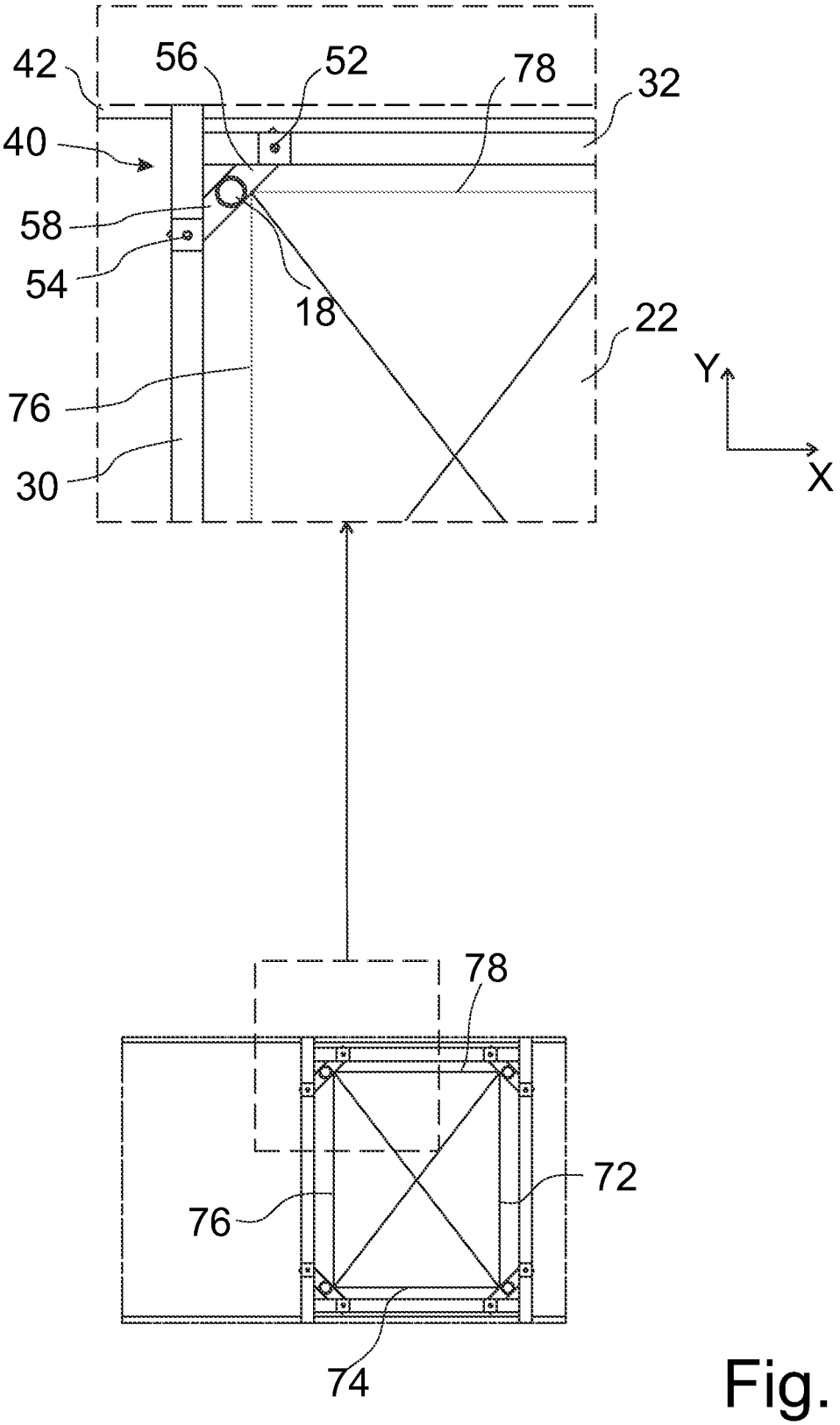
FIG. 3 schematically illustrates the partial top view of FIG. 2 and, in a detail view, one corner section of the furnace of the boiler according to an embodiment of the present solution.
Figure 4:
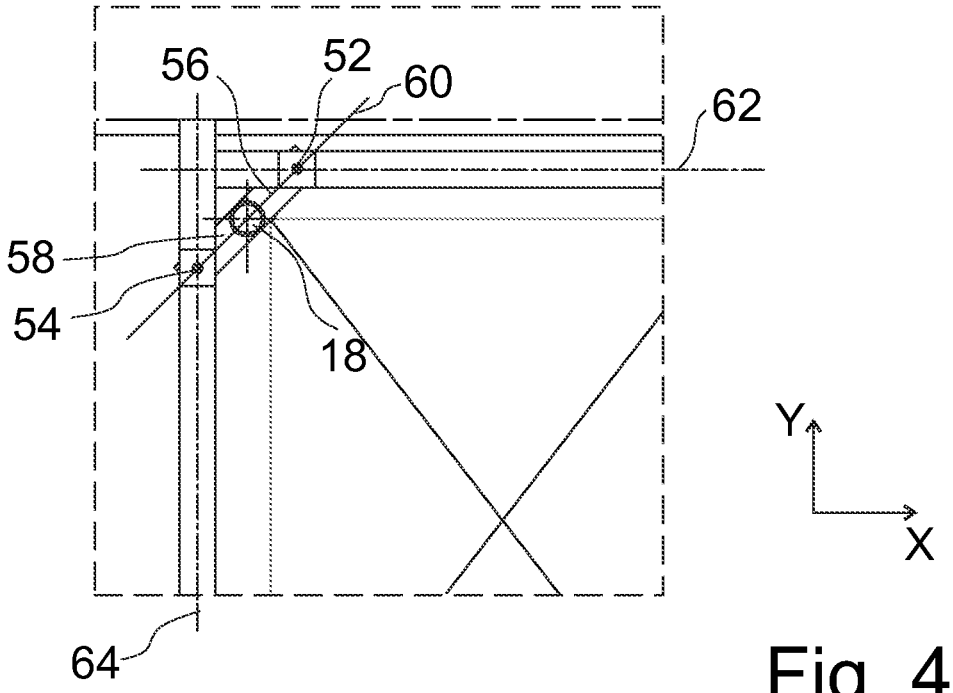
FIG. 4 schematically illustrates, in a detail view, the corner section of FIG. 3.

As shown in FIGS. 2 and 3, the furnace 22 comprises four vertical, planar water tube walls 72, 74, 76, 78 that are joined together such that in a horizontal plane, especially at the height of the above-mentioned supporting beams, they define a rectangular cross section with four corner sections. Two transversal water tube walls are joined at each corner section. One of the corner sections is denoted as the first corner section. To be taken as an example only, the first water tube wall 78 and the second water tube wall 76 may be joined at the first corner section shown in the detail view of FIG. 3.

Each water tube wall is made of water tubes attached to each other by means of welded joints, for example. Water to be evaporated into steam is conveyed inside the water tubes. The water tube walls 72, 74, 76, 78 are attached to each other by means of welded joints, for example.

The boiler 10 comprises a pipe 18 that extends vertically and is situated close to the first corner section, at least at the height of the above-mentioned supporting beams. The pipe 18 is situated outside the furnace 22.

The boiler 10 may comprise further pipes similar to the pipe 18 close to one or more of the corners sections, preferable close to each of the four corner sections. The further pipes may apply the same principles as the pipe 18 with regard to supporting the furnace 22.

Preferably, the cross-sectional area of the pipe 18 is larger than that of the water tubes in the water tube walls. Preferably, the pipe 18 has a cross section that is circular in a horizontal plane.

Preferably, the pipe 18 is situated off at least one of horizontal imaginary lines defined by the vertical planes of the water tube walls 76, 78.

The pipe 18 is for the transport of water and/or steam. Preferably, the pipe 18 is a downcomer for the downward transport of water.

According to an example and FIG. 1, the boiler 10 may comprise at least one lower header 20 that is situated below the water tube walls 76, 78. The lower header 20 supplies water that circulates in the water tube wall to at least one of the water tube walls 76, 78. According to an example and FIG. 1, there are two headers 20 that are situated below opposite water tube walls 74,78. The pipe 18 is attached to the lower header 20 for supplying water to the lower header 20. Thus, the furnace 22 is supported by the pipe 18 and the at least one lower header 20.

Preferably, the pipe 18 is attached to the furnace 22. According to an example and FIG. 1, the pipe 18 may be attached to the first corner section by means of a welded joint 80, 82 that extends vertically. Thus, the furnace 22 is supported to the pipe 18 by the welded joint 80, 82, for example. In this example, the furnace 22 may additionally be supported to the pipe 18 by the lower headers 20 explained above.

As shown in the examples of FIGS. 1 and 2, the support frame 12 comprises at least two but preferably four horizontal supporting beams 26, 28, 30, 32 that in a horizontal plane may define a rectangular space inside which the furnace 22, the four water tube walls 72, 74, 76, 78 and the at least one water pipe 18 are situated. Preferably, there are four pipes 18 inside the rectangular space. The supporting beams 26, 28, 30, 32 are separated from the water tube walls 72, 74, 76, 78.

Adjacent supporting beams that may define the rectangular space are transverse to each other, for example the first and second supporting beams 30, 32. Preferably, the adjacent supporting beams are substantially perpendicular in relation to each other.

Preferably, the supporting beam 26, 28, 30, 32 is substantially parallel with the water tube wall 72, 74, 76, 78 closest to it. For example, the first supporting beam 32 is parallel with the first water tube wall 78 and the second supporting beam 30 is parallel with the second water tube wall 76.

Alternatively, and in the example of FIG. 2, the supporting beam 16, 42 may take the place of the supporting beam 26, 32. Alternatively, the supporting beam 26, 32 may be attached to the supporting beam 16, 42 and/or the supporting beam 28, 30 may be supported to the supporting beam 16, 42 by the supporting beam 26, 32. In the example of FIG. 2 the supporting beam 26, 32 is supported to the supporting beam 16, 42 by the supporting beam 28, 30. Two or more supporting beams 16, 26, 28, 30, 32, 42 may be attached to each other in such a way that they are located at the same height or at different heights.

The furnace 22 of the boiler 10 is supported to the support frame 12 by at least one support assembly 34, 36, 38, 40 according to the solution. The support assembly is situated, for example, at the first corner section as shown in FIGS. 2, 3, 4, 5 and 6. Preferably, there are at least four support assemblies according to the solution, one at each corner section of the furnace 22. The other support assemblies 34, 36, 38 may apply parts and principles in the same way as the first support assembly 40 with regard to supporting the further pipes 18.

According to an example of the solution and FIG. 3, the support assembly 40 comprises a first assembly part 56 that attaches the pipe 18 to the first supporting beam 32. Thereby, the first pipe 18 is supported to the support frame 12 by the first assembly part 56. Additionally, the support assembly 40 comprises a second assembly part 58 that attaches the same pipe 18 to the second supporting beam 30. Thereby, the first pipe 18 is supported to the support frame 12 by the second assembly part 58.

Thereby, the support assembly 40 with two assembly parts 56, 58 provides the benefit of reducing the bending moments to which the pipe 18 is subjected, and furthermore, avoiding deflections, caused by loads incurred by the weights of the pipe 18 and the furnace 22 attached to the pipe 18. In the examples of FIGS. 1 and 2 the pipe 18 is attached to the first corner section in which case reduction of wall deflection is achieved.

The above-mentioned benefits are made possible by having not one but two points of support which provide two support forces, or two resultant support forces, that generate bending moments that cancel each other out either partly or completely at the location of the pipe 18. Each assembly part 56, 58 defines a point of support 52, 54 via which the above-mentioned loads are transmitted to either the first supporting beam 32 or the second supporting beam 30.

According to an example and FIG. 2, the two points of support 52, 54 are located at different supporting beams 30, 32 that are adjacent and transverse to each other.

Figure 6:
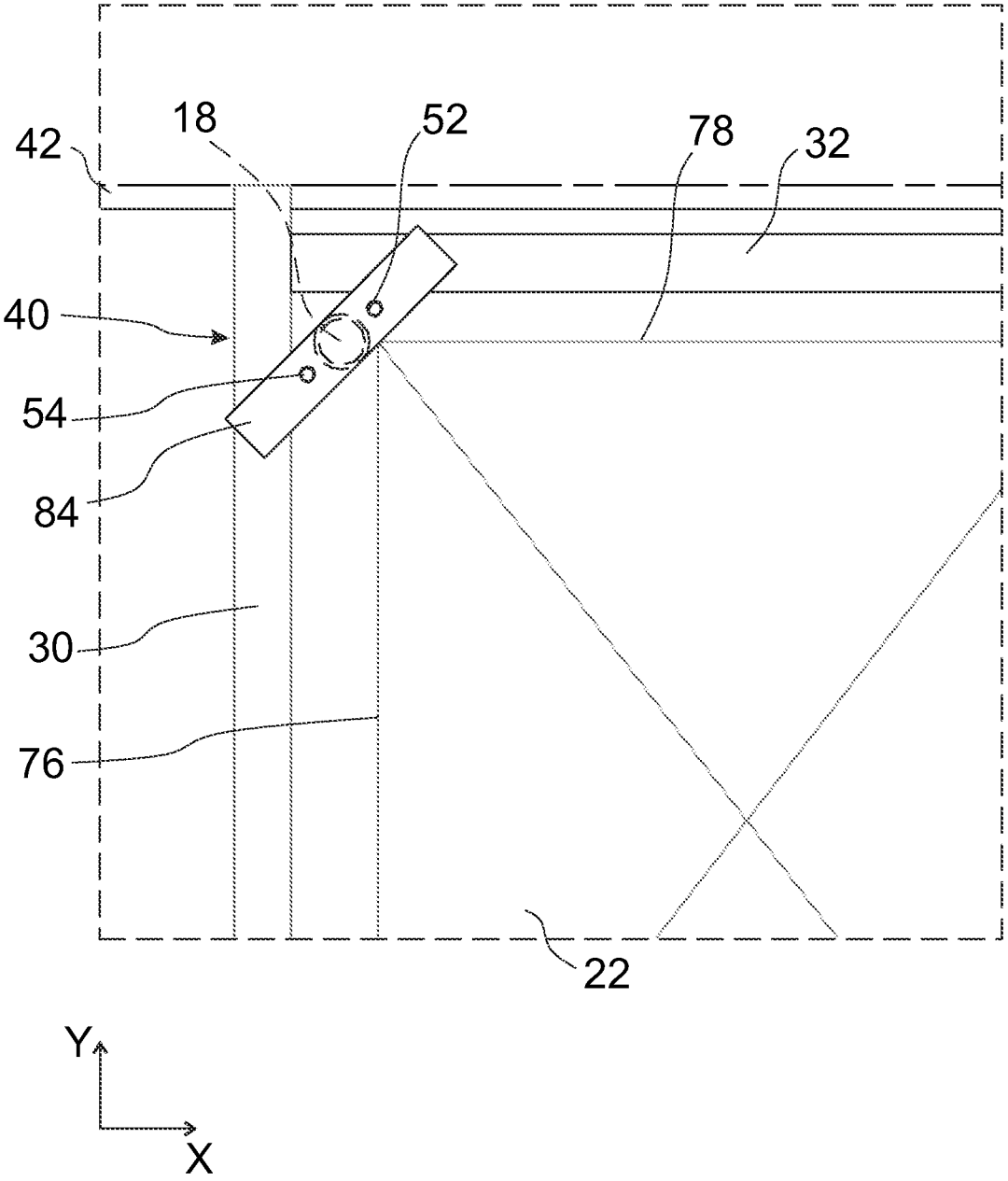
FIG. 6 schematically illustrates, in a detail view, one corner section of the furnace of the boiler of FIG. 3 according to yet another embodiment of the present solution.

According to an example and FIG. 6 the support frame 12 may at one or more corner sections comprise a connecting supporting beam 84 that is attached to two adjacent supporting beams 16, 26, 28, 30, 32, 42. The connecting supporting beam 84 is preferably horizontal and connects the two adjacent supporting beams. Therefore, in a horizontal plane, the position of the connecting supporting beam 84 is oblique in relation to the two supporting beams and the water tube walls of the furnace 22. For example, the connecting supporting beam 84 is attached to the first and second supporting beams 30, 32. The connecting supporting beam 84 may comprise a first end attached to a supporting beam, for example the first supporting beam 32, and a second end attached to an adjacent supporting beam, for example the second supporting beam 30.

In the example above, each assembly part 56, 58 defines the point of support 52, 54 in such a way that the above-mentioned loads are transmitted first to the connecting supporting beam 84 and then via the connecting supporting beam 84 to the first and second supporting beams 30, 32. According to the example, the two points of support 52, 54 are located at the connecting supporting beam 84.

According to an example and as shown in FIGS. 2, 3, 4, 5 and 6, the first point of support 52 is farther away from the second supporting beam 30 than the pipe 18 when viewed in a direction parallel to the longitudinal direction 62 of the first supporting beam 32. Additionally, the second point of support 54 is farther away from the first supporting beam 32 than the same pipe 18 when viewed in a direction parallel to the longitudinal direction 64 of the second supporting beam 30. Therefore, in a horizontal plane, the position of the support assembly 40 is oblique in relation to the supporting beams 30, 32 and the water tube walls 76, 78. This provides the benefit of having a compact support assembly.

According to an example and as shown in FIG. 6, the points of supports 52, 54 are in a horizontal plane preferably at a distance from the supporting beams 30, 32.

According to a first example and as shown in FIGS. 2, 3, 4, 5 and 6, the first and second points of support 52, 54 and the pipe 18 are situated in such a way that, in a horizontal plane, an imaginary straight line 60 (see FIG. 4) extending via the first and second points of support 52, 54 passes through the pipe 18 as well. This makes it possible that bending moments cancel each other out.

According to a second example, the pipe 18 may have a cross section that is circular in a horizontal plane and defines a centre. A first imaginary straight line is defined as extending horizontally via the centre and the first point of support 52. A second imaginary straight line is defined as extending horizontally via the centre and the second point of support 54. According to this example, the angular difference between the first and second imaginary straight lines is less than 35 degrees or preferably less than 25 degrees or most preferably less than 15 degrees. In the examples shown in FIGS. 2, 3, 4, 5 and 6, the angular difference is substantially 0 degrees for improved cancellation of bending moments.

According to a third example and as shown in FIGS. 2, 3, 4, 5 and 6, the pipe 18 may have a cross section that is circular in a horizontal plane and defines a centre. A first distance is defined as the horizontal distance between the centre and the first point of support 52 and a second distance is defined as the horizontal distance between the same centre and the second point of support 54. According to this example, the first distance substantially equals the second distance. This provides the benefit of cancellation of bending moments, especially when applied with the first example and/or the second example mentioned above.

According to a fourth example and as shown in FIGS. 2, 3, 4, 5 and 6, the first and second points of support 52, 54 are, in a horizontal plane, situated on opposite sides of the pipe 18. This makes it possible that bending moments may cancel each other out.

One or more of the four examples presented above may be applied simultaneously.

Figure 7:
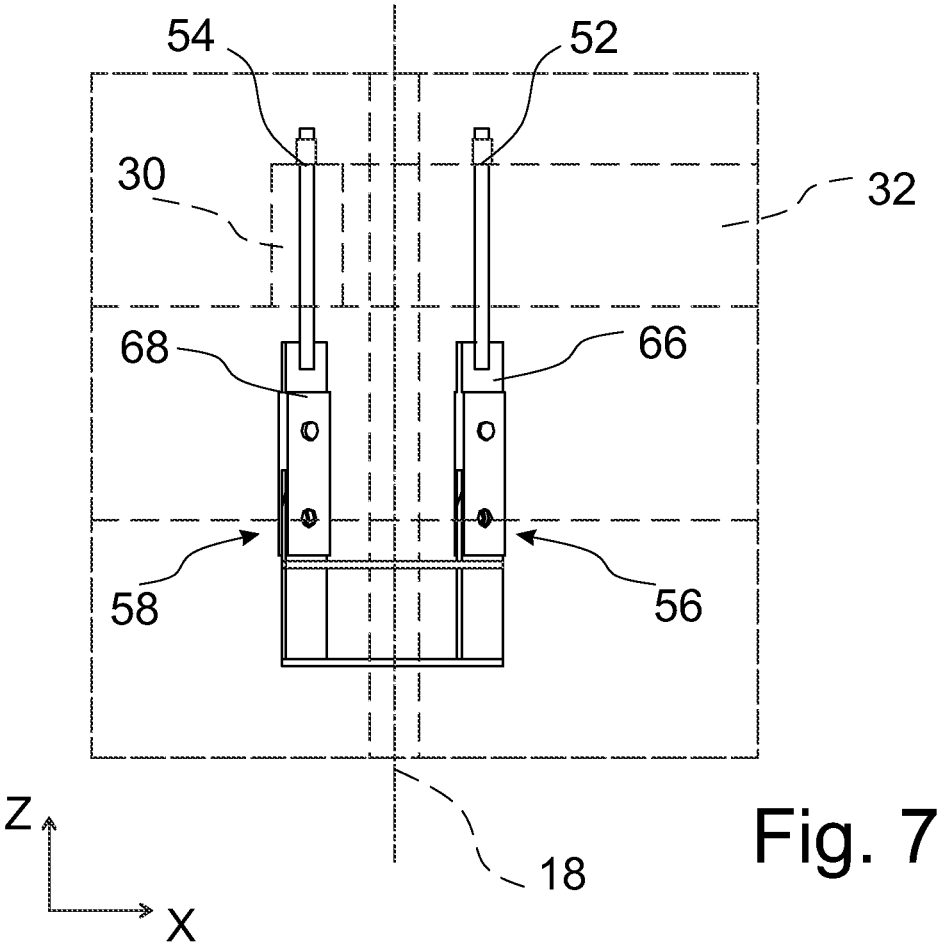
FIG. 7 schematically illustrates, in a simplified manner, a side view of an example support assembly, especially adjustable hanger rods, applied in a boiler plant, a boiler and a support frame according to an embodiment of the present solution, for example in the boiler plant, the boiler and the support frame shown in FIGS. 1, 2, 3, 4 and 6.

According to an example and FIG. 7, and as applied in FIGS. 2, 3, 4 and 6, the first assembly part 56 may comprise a first suspension device 66 (see FIG. 7) that suspends the pipe 18 from the first supporting beam 32. Additionally, the second assembly part 58 may comprise a second suspension device 68 (see FIG. 7) that suspends the same pipe 18 from the second supporting beam 30. In the example of FIG. 6, the connecting supporting beam 84 takes the place of the first and second supporting beams 30, 32. The first and second suspension devices 66, 68 provide the first and second points of support 52, 54, respectively. The first assembly part 56 or the second assembly part 58, or both, may comprise a bracket that is attached to the pipe 18 for attaching the pipe 18 to the first or second suspension device 66, 68.

According to an example of the solution and according to FIG. 7, the first suspension device 66 or the second suspension device 68, or both, is an adjustable hanger rod. In the case of the adjustable hanger rod, the first or second point of contact 52, 54 may coincide with an imaginary vertical line extending via the adjustable hanger rod. Preferably, the point of contact 52, 54 is situated on the first or second supporting beam 30, 32. Alternatively and in the example of FIG. 6, the point of contacts 52, 54 are situated on the connecting supporting beam 84.

Figure 8:
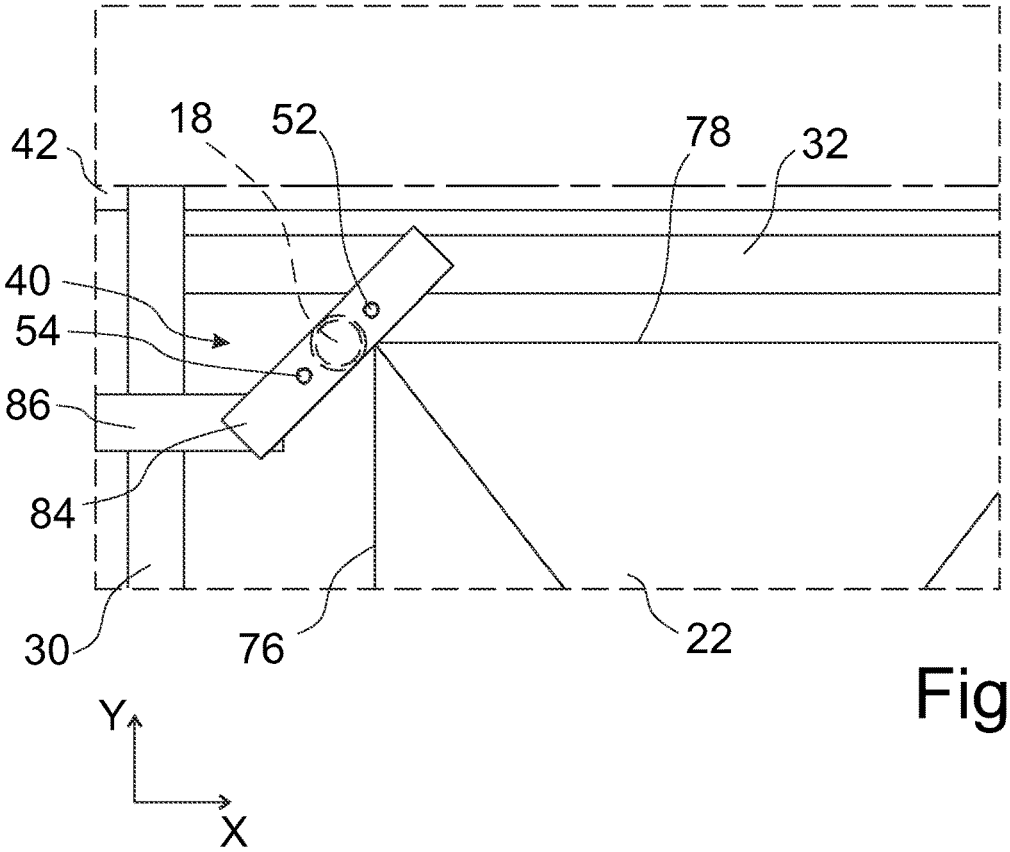
FIG. 8 schematically illustrates, in a detail view, the corner section of the furnace of the boiler of FIG. 6 according to an additional embodiment of the present solution.
Figure 9:
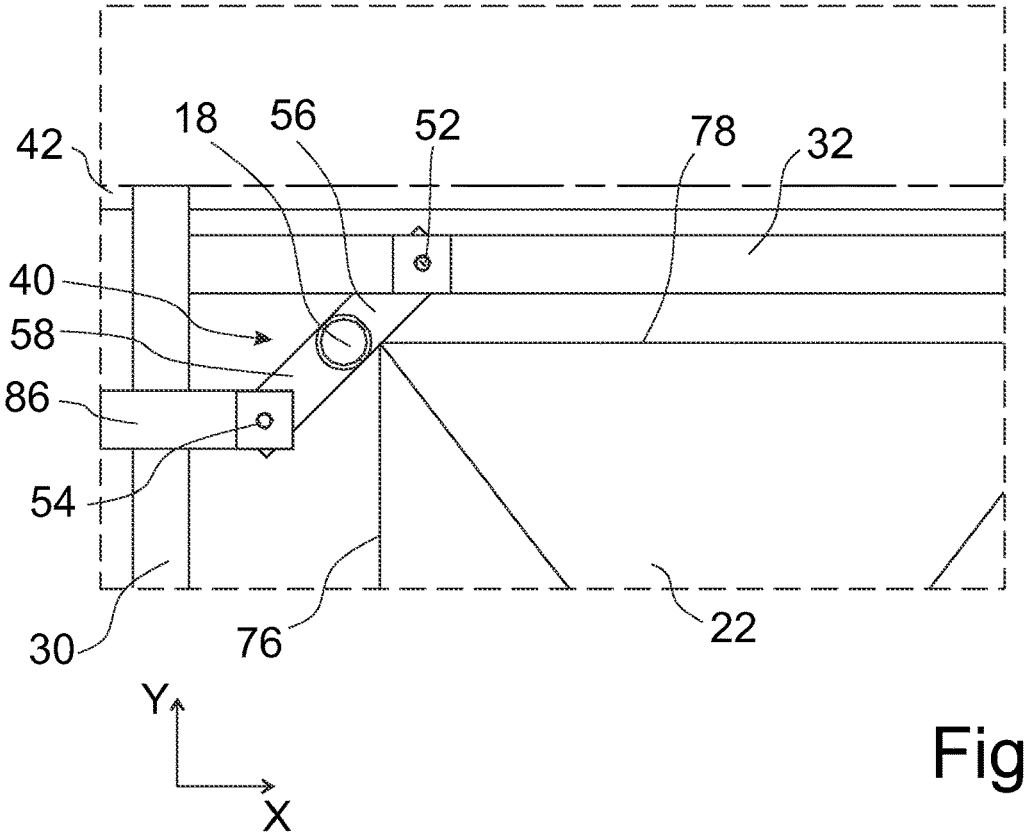
FIG. 9 schematically illustrates, in a detail view, the corner section of the furnace of the boiler of FIGS. 2 and 3 according to additional embodiment of the present solution.
Figure 10:
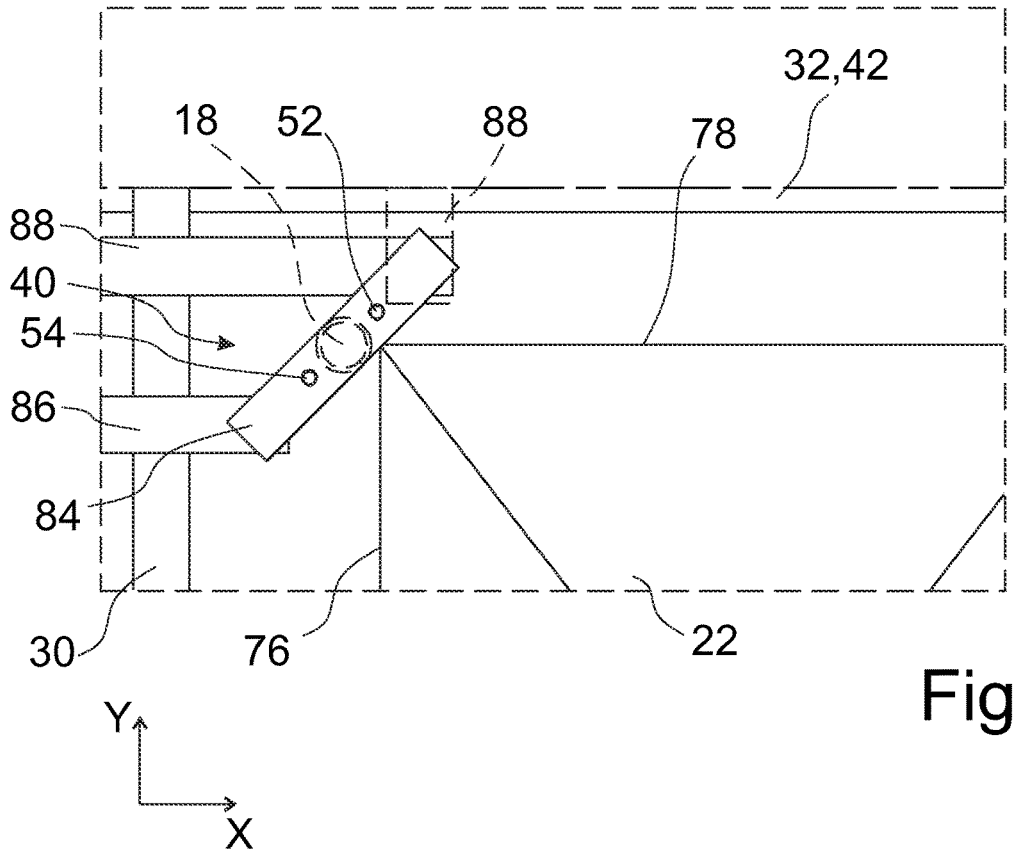
FIG. 10 schematically illustrates, in a detail view, the corner section of the furnace of the boiler of FIG. 6 according to a further embodiment of the present solution.
Figure 11:
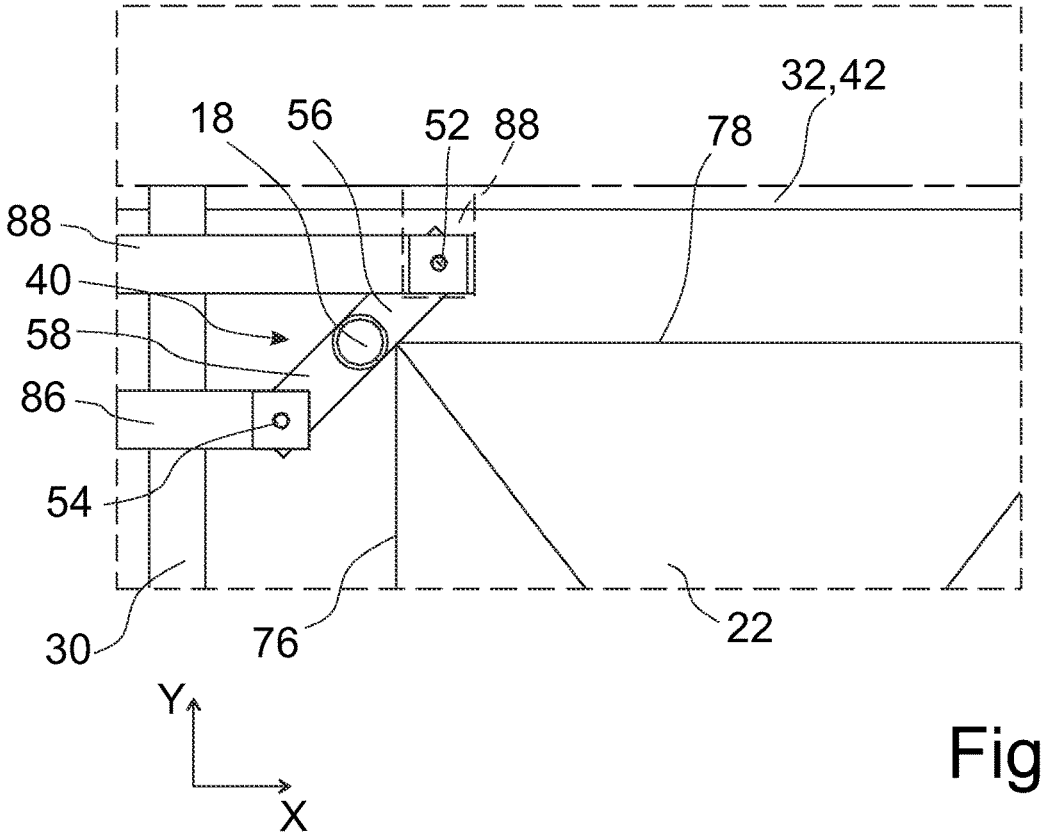
FIG. 11 schematically illustrates, in a detail view, the corner section of the furnace of the boiler of FIGS. 2 and 3 according to a further embodiment of the present solution.

In FIGS. 8 and 10 examples supplemental to the example shown in FIG. 6 are shown and in FIGS. 9 and 11 examples supplemental to the example shown in FIGS. 2 and 3 are shown. In the examples the support frame 12 may at the one or more corner sections comprise an additional supporting beam 86, 88 supported to another supporting beam 16, 26, 28, 30, 32, 42. The supporting beam 86, 88 is preferably horizontal, preferably separated from the water tube walls 72, 74, 76, 78, or may form a cantilever beam at the supporting beam 16, 26, 28, 30, 32, 42. The supporting beam 86, 88 may be placed on or under or on the same level with the supporting beam 16, 26, 28, 30, 32, 42. There is preferably one or two, or more, additional supporting beams 86, 88.

In the examples of FIGS. 10 and 11 the additional, third supporting beam 88 is supported to the second supporting beam 30. Alternatively, the third supporting beam 88 is supported to the first supporting beam 32 as shown with a dash line. The additional supporting beam 86, 88 may e.g. be attached to the respective supporting beam 30, 32 for providing support.

In the examples of FIGS. 8, 9, 10 and 11 the additional, fourth supporting beam 86 is supported to the second supporting beam 30.

In relation to the structure of the supporting beams, the pipe 18, the first and second suspension devices 66, 68, the support assembly 40, the connecting supporting beam 84, the assembly parts 56, 58 and the points of support 52, 54 the examples in FIGS. 8, 9, 10 and 11 may apply the principles already explained in this description and relating to the examples in FIG. 6 and FIGS. 2 and 3.

In the examples of FIGS. 8 and 10 the first end of the connecting supporting beam 84 is attached to the third supporting beam 88 (see FIG. 10) or to the first supporting beam 32 (see FIG. 8), the second end being attached to an adjacent supporting beam, for example the fourth supporting beam 86.

In FIG. 10 the third supporting beam 88, when being supported to the first supporting beam 32 instead of being supported to the second supporting beam 30, is shown as an option marked with a dash line denoting purported location. In FIG. 8 the third supporting beam 88 is not in use.

According to an example, both the third supporting beam 88 and the fourth supporting beam 86 are in use and each end of the connecting supporting beam 84 is attached to the third or fourth supporting beam 86, 88 as described above in relation to FIG. 10.

In the examples above and in FIGS. 8 and 10, each assembly part 56, 58 defines the point of support 52, 54 in such a way that the above-mentioned loads are transmitted first to the connecting supporting beam 84 and then via it, and via the fourth supporting beam 86, and/or the third supporting beam 88, to the first and second supporting beams 30, 32. In FIG. 8 the third supporting beam 88 is not in use and the above-mentioned loads are transmitted to the first supporting beam 32 directly via the connecting supporting beam 84. According to the examples, the two points of support 52, 54 are located at the connecting supporting beam 84, see FIGS. 8 and 10.

In the examples above and in FIGS. 9 and 11, each assembly part 56, 58 defines the point of support 52, 54 via which the above-mentioned loads are transmitted first to the fourth supporting beam 86, and/or the third supporting beam 88, and then via the fourth supporting beam 86, and/or the third supporting beam 88, to the first and second supporting beams 30, 32. In FIG. 9 the third supporting beam 88 is not in use and the above-mentioned loads are transmitted to the first supporting beam 32 directly via the first point of support 52. According to the examples, the first point of support 52 is located at the first supporting beam 32 (see FIG. 9) or at the third supporting beam 88 (see FIG. 11), and the second point of support 54 is located at the fourth supporting beam 86, see FIGS. 9 and 11.

In the examples above, the use of the third and/or fourth supporting beams 86, 88 brings the benefit of providing more space between the furnace 22 and the first and/or second supporting beams 30, 32.

In the examples according to FIGS. 8, 9, 10 and 11, the fourth supporting beam 86 and the second supporting beam 30 may be transverse to each other, when the fourth supporting beam 86 is supported to the second supporting beam 30. In this case, the fourth supporting beam 86 may be parallel with the first supporting beam 32. Additionally, in the examples of FIGS. 10 and 11, the third supporting beam 88 and the second supporting beam 30 may be transverse to each other, when the third supporting beam 88 is supported to the second supporting beam 30. In this case, the third supporting beam 88 may be parallel with the first supporting beam 32. Alternatively, as shown with a dash line in the examples of FIGS. 10 and 11, the third supporting beam 88 and the first supporting beam 32 may be transverse to each other, when the third supporting beam 88 is supported to the first supporting beam 32. Thus, in the examples of FIGS. 10 and 11, the third supporting beam 88 and the fourth supporting beam 86 may be transverse to or parallel with each other.

In the examples of FIGS. 8, 9, 10 and 11, the fourth supporting beam 86 may be at a distance from the first supporting beam 32 and the third supporting beam 88 when viewed in a direction parallel to the longitudinal direction 64 of the second supporting beam 30. Preferably, in FIGS. 10 and 11, the third supporting beam 88 is at a distance from the first supporting beam 32 when viewed in a direction parallel to the longitudinal direction 64 of the second supporting beam 30. Thus, the pipe 18 may be located between the first supporting beam 32 and the fourth supporting beam 86, or, between the third and fourth supporting beams 86, 88 when viewed in the above-mentioned direction.

In the examples of FIGS. 8, 9, 10 and 11, the fourth supporting beam 86 may extend nearer to the water tube wall 76 than the second supporting beam 30 when viewed in a direction parallel to the longitudinal direction 62 of the first supporting beam 32. Preferably, in the examples of FIGS. 10 and 11, the third supporting beam 88 extends farther away from the second supporting beam 30 than the fourth supporting beam 86 when viewed in a direction parallel to the longitudinal direction 62 of the first supporting beam 32. In the examples shown with a dash line, the third supporting beam 88 may extend nearer to the water tube wall 78 than the first supporting beam 32 when viewed in a direction parallel to the longitudinal direction 64 of the second supporting beam 30.

Figure 5:
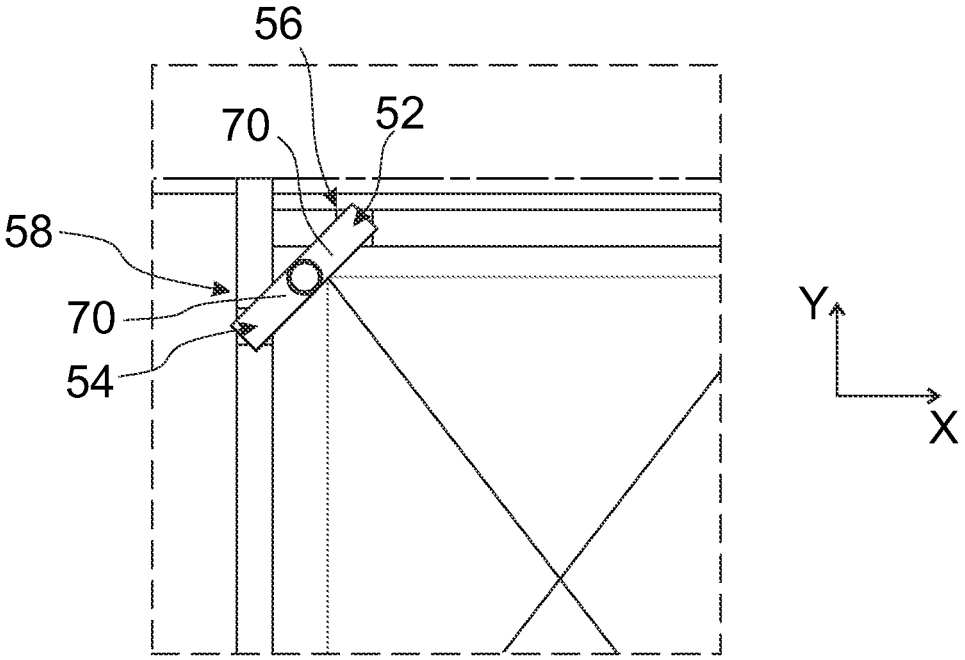
FIG. 5 schematically illustrates, in a detail view, one corner section of the furnace of the boiler of FIG. 3 according to another embodiment of the present solution.

Alternatively, according to an example and as shown in FIG. 5, the first assembly part 56 or the second assembly part 58, or both, may comprise a supporting leg 70 that is supported by the first or second supporting beam 30, 32. In the case of the supporting leg 70, the first or second point of contact 52, 54 may be situated on the first or second supporting beam 30, 32, under the supporting leg 70. The first assembly part 56 or the second assembly part 58, or both, may comprise a bracket that is attached to the tube 18 for attaching the pipe 18 to the supporting leg 70.

The principles in the examples presented above in relation to the structure, location and position of the third and fourth supporting beams 86, 88, and those of the third and fourth supporting beams 30, 32, apply to the example of FIG. 5 as well. Each supporting leg 70 is supported by the first or second supporting beam 30, 32, or alternatively, by the third or fourth supporting beam 86, 88 shown in FIG. 8, 9, 10 or 11. Therefore, the first or second point of contact 52, 54 may be situated on the third or fourth supporting beam 86, 88, under the supporting leg 70. Preferably, the third supporting beam 88 is not in use and the fourth supporting beam 86 is in use.

Functions and elements described in connection with an example above may be used also in the other examples presented above where appropriate. Especially, it should be noted that the examples above may be applied in all four corner sections of the furnace 22 of the boiler 10. The solution presented above in relation to the support assembly may be applied in the four corner sections.

While the invention has been described by way of examples it is to be understood that the solution is not limited to the disclosed examples but is intended to cover various combinations or modifications within the scope of the appended claims.

The invention claimed is:

1. A support assembly for supporting a furnace of a boiler to a support frame of the boiler, wherein the furnace comprises four vertical, planar water tube walls which are joined together and which, in a horizontal plane, define a rectangular cross section with four corner sections, two of the water tube walls being joined in each corner section, the four corner sections including a first corner section at which a first water tube wall and a second tube wall that are transverse to each other are joined, wherein the boiler further comprises at least one vertically extending pipe that is for the transport of water and/or steam and situated outside the furnace, the pipe being close to the first corner section, and wherein the support frame further comprises at least two horizontal supporting beams, the at least two horizontal support beams being separated from the water tube walls and including a first supporting beam and a second supporting beam that are transverse to each other, wherein the support assembly close to the first corner section comprises:

a first assembly part that comprises a first suspension device and attaches the pipe to the first supporting beam or to a third supporting beam that is supported by the first supporting beam or by the second supporting beam, wherein the first suspension device provides, at the first supporting beam or at the third supporting beam, a first point of support where loads incurred by the weight of the pipe and the furnace attached to the pipe are transmitted to the first supporting beam or to the third supporting beam, and wherein the first suspension device is configured to suspend the pipe from the first supporting beam or from the third supporting beam, and a second assembly part that comprises a second suspension device and attaches the same pipe to a fourth supporting beam that is supported by the second supporting beam, wherein the second suspension device provides, at the fourth supporting beam, a second point of support where loads incurred by the weight of the pipe and the furnace attached to the pipe are transmitted to the fourth supporting beam, and wherein the second suspension device is configured to suspend the same pipe from the fourth supporting beam.

2. The support assembly of claim 1, wherein the support assembly is oblique in relation to the first and second supporting beams.

3. The support assembly of claim 1, wherein:

the third supporting beam is parallel with the first supporting beam and transverse to the second supporting beam when the third supporting beam is supported by the second supporting beam, and the third supporting beam is parallel with the second supporting beam and transverse to the first supporting beam when the third supporting beam is supported by the first supporting beam.

4. The support assembly of claim 1, wherein the fourth supporting beam is parallel with the first supporting beam and transverse to the second supporting beam when the fourth supporting beam is supported by the second supporting beam.

5. The support assembly of claim 1, wherein:

the third supporting beam is a cantilever beam, the fourth supporting beam is a cantilever beam, or both the third and fourth supporting beams are cantilever beams.

6. A support assembly for supporting a furnace of a boiler to a support frame of the boiler, wherein the furnace comprises four vertical, planar water tube walls which are joined together and which, in a horizontal plane, define a rectangular cross section with four corner sections, two of the water tube walls being joined in each corner section, the four corner sections including a first corner section at which a first water tube wall and a second tube wall that are transverse to each other are joined, wherein the boiler further comprises at least one vertically extending pipe that is for the transport of water and/or steam and situated outside the furnace, the pipe being close to the first corner section, and wherein the support frame further comprises:

at least two horizontal supporting beams that are separated from the water tube walls and include a first supporting beam and a second supporting beam that are transverse to each other, and a connecting supporting beam that is oblique in relation to the first and second supporting beams, that is separated from the water tube walls, and that comprises:

a first end attached to the first supporting beam, or to a third supporting beam that is supported by the first supporting beam or by the second supporting beam, and a second end attached to the second supporting beam, or to a fourth supporting beam supported by the second supporting beam, and wherein the support assembly close to the first corner section comprises:

a first assembly part that comprises a first suspension device and attaches the pipe to the oblique connecting supporting beam, wherein the first suspension device provides, at the oblique connecting supporting beam, a first point of support where loads incurred by the weight of the pipe and the furnace attached to the pipe are transmitted to the oblique connecting supporting beam, and wherein the first suspension device is configured to suspend the pipe from the oblique connecting supporting beam, and a second assembly part that comprises a second suspension device and attaches the same pipe to the oblique connecting supporting beam, wherein the second suspension device provides, at the oblique connecting supporting beam, a second point of support where loads incurred by the weight of the pipe and the furnace attached to the pipe are transmitted to the oblique connecting supporting beam, and wherein the second suspension device is configured to suspend the same pipe from the oblique connecting supporting beam.

7. The support assembly of claim 6, wherein:

the first point of support is farther away from the second supporting beam than the pipe when viewed in a direction parallel to the longitudinal direction of the first supporting beam, and the second point of support is farther away from the first supporting beam than the same pipe when viewed in a direction parallel to the longitudinal direction of the second supporting beam.

8. The support assembly of claim 6, wherein the first corner section is attached to the pipe by means of a welded joint extending vertically, or, the pipe is separated from the water tube walls.

9. The support assembly of claim 6, wherein:

the boiler further comprises at least one lower header that is situated below the water tube walls and is attached to the water tube walls for supplying water to the water tube walls, the pipe is attached to the at least one lower header for supplying water to the at least one lower header, and the furnace with the water tube walls is supported by the pipe and the at least one lower header.

10. The support assembly of claim 6, wherein the pipe is a downcomer for the downward transport of water.

11. The support assembly of claim 6, wherein the first suspension device and the second suspension device are adjustable hanger rods.

12. The support assembly of claim 6, wherein the first and second points of support and the pipe are situated in such a way that, in a horizontal plane, an imaginary straight line extending via the first and second points of support passes through the pipe also.

13. The support assembly of claim 6, wherein:

the pipe comprises a cross section that is circular in a horizontal plane and defines a centre for the pipe, a first distance is defined as a horizontal distance between the centre and the first point of support and a second distance is defined as a horizontal distance between the centre and the second point of support, and the first distance substantially equals the second distance.

14. The support assembly of claim 6, wherein:

the pipe comprises a cross section that is circular in a horizontal plane and defines a centre for the pipe, a first portion of an imaginary straight line is defined as extending horizontally via the centre and the first point of support and a second portion of the imaginary straight line is defined as extending horizontally via the centre and the second point of support, and the angular difference between the first and second portions of the imaginary straight line is one of less than 35 degrees, less than 25 degrees, and less than 15 degrees.

15. The support assembly of claim 6, wherein the first and second points of support are in a horizontal plane at a distance from the first and second supporting beams.

16. A support assembly for supporting a furnace of a boiler to a support frame of the boiler, wherein the furnace comprises four vertical, planar water tube walls which are joined together and which, in a horizontal plane, define a rectangular cross section with four corner sections, two of the water tube walls being joined in each corner section, the four corner sections including a first corner section at which a first water tube wall and a second tube wall that are transverse to each other are joined, wherein the boiler further comprises at least one vertically extending pipe that is for the transport of water and/or steam and situated outside the furnace, the pipe being close to the first corner section, and wherein the support frame further comprises at least two horizontal supporting beams, the at least two horizontal supporting beams being separated from the water tube walls and including a first supporting beam and a second supporting beam that are transverse to each other, wherein the support assembly close to the first corner section comprises a first assembly part that comprises a first supporting leg and attaches the pipe to the first supporting beam, or to a third supporting beam that is supported by the first supporting beam or by the second supporting beam, wherein the first assembly part defines, at the first supporting beam or at the third supporting beam, a first point of support under the first supporting leg on the first supporting beam or the third supporting beam, the first point of support being where loads incurred by the weight of the pipe and the furnace attached to the pipe are transmitted to the first supporting beam or to the third supporting beam, and wherein the first supporting leg is supported on the first supporting beam or the third supporting beam and provides the first point of support, and a second assembly part that comprises a second supporting leg and attaches the same pipe to the second supporting beam, or to a fourth supporting beam that is supported by the second supporting beam, wherein the second assembly part defines, at the second supporting beam or at the fourth supporting beam, a second point of support under the second supporting leg on the second supporting beam or the fourth supporting beam, the second point of support being where loads incurred by the weight of the pipe and the furnace attached to the pipe are transmitted to the second supporting beam or to the fourth supporting beam, wherein the second supporting leg is supported on the second supporting beam or the fourth supporting beam and provides the second point of support, and wherein the first and second assembly parts including the first and second supporting legs are oblique in relation to the first and second supporting beams in such a way that:

the first point of support is farther away from the second supporting beam than the pipe when viewed in a direction parallel to the longitudinal direction of the first supporting beam, and the second point of support is farther away from the first supporting beam than the same pipe when viewed in a direction parallel to the longitudinal direction of the second supporting beam.

17. The support assembly of claim 16, wherein the first corner section is attached to the pipe by means of a welded joint extending vertically, or, the pipe is separated from the water tube walls.

18. The support assembly of claim 16, wherein the pipe is a downcomer for the downward transport of water.

19. The support assembly of claim 16, wherein the first and second points of support and the pipe are situated in such a way that, in a horizontal plane, an imaginary straight line extending via the first and second points of support passes through the pipe also.

20. The support assembly of claim 16, wherein:

the pipe comprises a cross section that is circular in a horizontal plane and defines a centre for the pipe, a first distance is defined as a horizontal distance between the centre and the first point of support and a second distance is defined as a horizontal distance between the centre and the second point of support, and the first distance substantially equals the second distance.

21. The support assembly of claim 16, wherein:

the pipe comprises a cross section that is circular in a horizontal plane and defines a centre for the pipe, a first portion of an imaginary straight line is defined as extending horizontally via the centre and the first point of support and a second portion of the imaginary straight line is defined as extending horizontally via the centre and the second point of support, and the angular difference between the first and second imaginary straight lines is one of less than 35 degrees, less than 25 degrees, and less than 15 degrees.

* * * * *